US006021912A

United States Patent [19]

Hertrampf

[11] Patent Number: 6,021,912

[45] Date of Patent: Feb. 8, 2000

[54] CLOSURE FOR A BOTTLE OR THE LIKE

[75] Inventor: Michael Hertrampf, Gehrden, Germany

[73] Assignee: Safety Cap Systems AG, Ch-Biel-Benken, Switzerland

[21] Appl. No.: 09/051,710

[22] PCT Filed: Oct. 25, 1996

[86] PCT No.: PCT/EP96/04646

§ 371 Date: Apr. 17, 1998

§ 102(e) Date: Apr. 17, 1998

[87] PCT Pub. No.: WO97/16356

PCT Pub. Date: May 9, 1997

[30] Foreign Application Priority Data

Oct. 31, 1995 [DE] Germany ..... 195 40 560
Apr. 6, 1996 [DE] Germany ..... 196 13 830

[51] Int. Cl.[7] ..... B65D 51/16; B65D 53/02

[52] U.S. Cl. ..... 215/344; 215/260; 215/270; 215/345

[58] Field of Search ..... 215/344, 260, 215/270, 271, 311, 307, 329, 341, 343, 354, 902, 345; 220/203.01, 203.09, 203.29, 303

[56] References Cited

U.S. PATENT DOCUMENTS 3,047,177 7/1962 Poitras et al. .

FOREIGN PATENT DOCUMENTS 0 060 218 2/1982 European Pat. Off. .
0 184 959 11/1985 European Pat. Off. .
0 464 384 6/1991 European Pat. Off. .
0 575 987 6/1993 European Pat. Off. .
1 154 161 4/1958 France .
42 03 238 2/1992 Germany .
42 41 341 12/1992 Germany .
958 417 6/1962 United Kingdom .
2 013 635 1/1979 United Kingdom .
20 13 635 1/1979 United Kingdom .

*Primary Examiner*—Allan N. Shoap
*Assistant Examiner*—Niki M. Eloshway
*Attorney, Agent, or Firm*—Shlesinger, Arkwright & Garvey LLP

[57] ABSTRACT

A closure for a bottle, comprising a cap-shaped closure component; a projection directed inwardly from an edge of the cap-shaped closure component to grip behind an outwardly directed projection at a neck of a bottle; a substantially cylindrical sealing element extending axially from a bottom of the closure component, the sealing element being disposed within the closure component; and a radial projection formed outside of the sealing element and disposed away from the bottom and having a diameter larger than the inside diameter of the neck of the bottle to be sealed by the closure means in such a way that a sealing surface formed by the radial projection tightly rests against an inside surface of the neck in a closed mode. The bottom comprises a cross-sectional slimming disposed radially beyond the cylindrical sealing element, the slimming having a thickness less than the thickness of an adjacent portion of the bottom such that the slimming functions as a hinge. The bottom and the sealing element form an elbow lever pivotable about the hinge. At least one rib is disposed in a space formed between the bottom and the sealing element to brace the sealing element against movement relative to the bottom, such that upon bulging of the bottom the radial projection is substantially radially detached from the inside surface of the neck by a lever action of the elbow lever pivotable about the hinge.

7 Claims, 1 Drawing Sheet

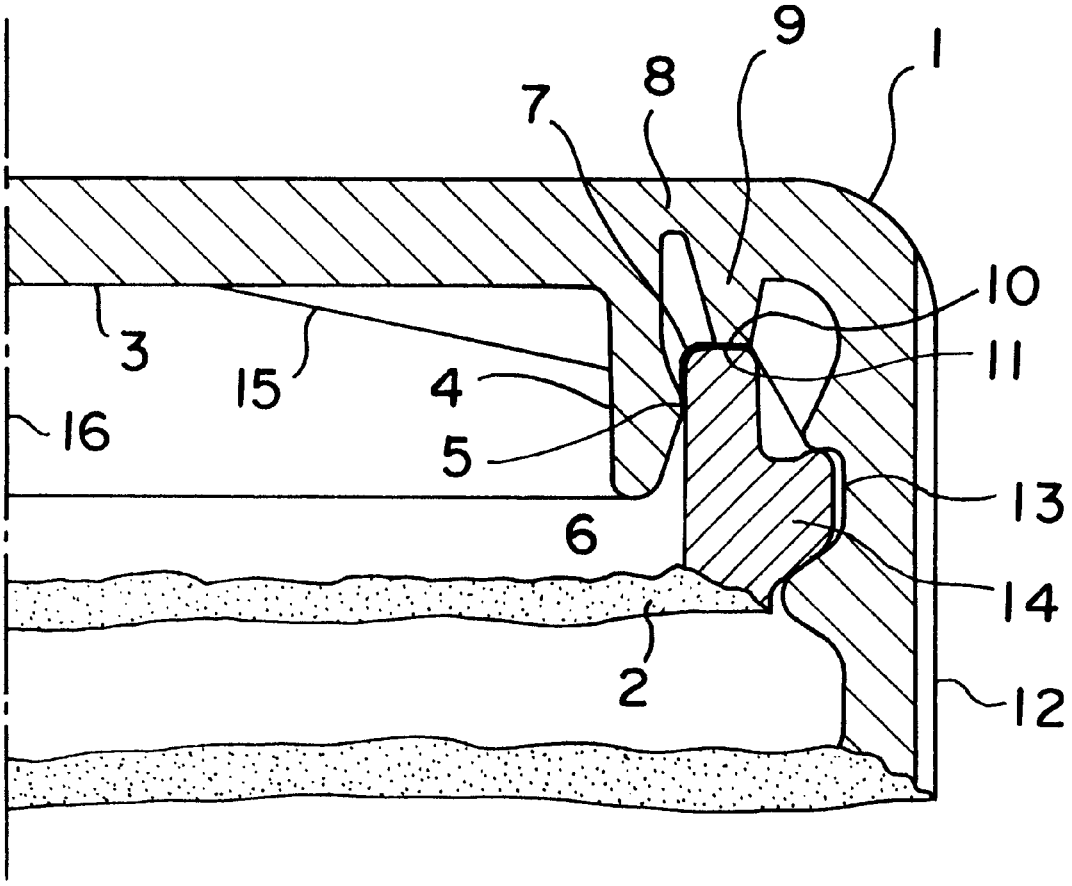
9
1
8
7
10
3
11
15
4
16
5
13
6
14
2
12

CLOSURE FOR A BOTTLE OR THE LIKE

FIELD OF THE INVENTION

The invention concerns a closure means for a bottle or the like.

BACKGROUND OF THE INVENTION

The British patent document 2,013,635 A discloses a closure means of this kind wherein the radial projection rests against the inside wall of the bottle neck in the immediate vicinity of its own orifice rim. The cylindrical sealing element is very short and the outside of the projection lies closely to the bottom of the cap-shaped closure component. The bottom bulges outwardly in case of overpressure. When deforming in this convex manner, the sealing projection follows said mainly axially directed bulging until, at a given overpressure and hence at a given bulge, it is released from in the inner mouth rim of the bottle's neck and in this manner subtends gap through which the overpressure may be relieved. In this manner the said sealing means forms an overpressure valve averting bottle bursting and entailed dangers.

This known closure means incurs a drawback in that in practice the front inner rim at the mouth of the bottle neck demands high precision of manufacture, so that no defined rest of the sealing projection is assured exactly in the critical range wherein the overpressure valve formed by the closure means shall open and close. In addition, as regards such bottles, and especially those glass bottles to be reused several times, the inner rim edge of the bottle neck is damaged and thus will not be sealing.

Another drawback of this known closure means is that on account of pressure changes arising in practice by heating and then cooling the contents of the bottle fitted with said closure means, the sealing projection steadily slides in the axial direction on the inside surface of the mouth of the bottle acting as a valve seat, whereby the sealing surface of the projection may be abraded or damaged and then be leaking.

Lastly the known closure means incurs the drawback that the necessity of axial displacement in turn requires axial yielding by the cap outside the cylindrical sealing element. This requirement is met in this known closure means embodied by a screw cap by shearing the bottom outside the cylindrical sealing element and by axially stretching the outer cylindrical part. However said stretching includes prestressing which in turn depends on the screw-on torque, in any event it depends during customer use on the particular torque applied by the user in screwing on the screw cap. Consequently the pressure at which for safety reasons there shall be pressure relief will not be provided with the desired reliability to preclude bottle bursting at excessive pressure.

The British patent document 958,417 discloses a closure means of a similar kind, also in the form of a screw cap fitted with projections inside its bottom and serving as stops and coming to rest against the rim edge of a bottle neck when said cap is being screwed onto it. In this design the stretching of the outer cap part comprising the thread is not utilized to impart axial displaceability to the bottom. The elasticity of this axial displaceability being determinant for the opening pressure, whereas only the region between the cylindrical sealing element and the outer rim of the top end of the bottle neck are available for yielding, the bottom must be made very thin to achieve adequately elastic yielding. This feature is a drawback, the more so that it entails very tight manufacturing tolerances.

The objective of the invention is to create a closure means of the kind defined in the preamble of claim 1 wherein inaccuracies of or damage to the front inner edge of the mouth of a bottle neck are not disadvantageous and where its sealing will not be degraded even in the presence of frequent pressure changes.

SUMMARY OF THE INVENTION

The basic concept of the disclosure of the invention is to implement the opening of the overpressure valve formed between the closure means and the neck of a bottle not by an axial displacement of the sealing projection along the sealing element, whereby the position and nature of the front inside edge of the mouth of a bottle neck assume predominant significance, instead by a radially inward displacement of the sealing projection. This radial displacement is implemented in that a cross-sectional slimming acting as a hinge is present in the bottom directly radially outside the cylindrical sealing element. Said slimming causes a peripheral zone of the closure component, as seen in the bottom's cross-section, to rotate about the hinge so formed when said bottom is made to bulge, whereas the outer region remains substantially unaffected. Because the cylindrical sealing part is solidly joined directly inside from the hinge to the bottom and because in this manner an elbow lever is formed between the bottom and the cylindrical sealing element, it follows that, upon bottom bulging, the sealing element pivots inward and as a result the sealing projection at its outer surface of said element is pressure-relieved and, upon sufficient pressure, will detach off the cylindrical inside surface of the bottle neck.

To ensure this radial pressure relief or this radial detachment under all circumstances, the radially sealing projection is so mounted in a special feature of the invention that for all bottom bulging caused by overpressure said projection shall be located in the region of the substantially cylindrical inside surface of the bottle neck.

The above discussion relates essentially to cross-sectional views, the cylindrical sealing element so viewed then actually forming a lever. In reality however a cylinder is involved, and therefore the cross-sectionally viewed lever effect in reality is a cross-sectional slimming of the cylindrical sealing element relative to the periphery. However pressure relief or detachment of the projection remain unaffected. Obviously the mechanical conditions also are affected by the length and rigidity of the cylindrical sealing element, however these are parameters which can be selected by a typical expert. The same consideration applies to the design of the hinge-forming cross-sectional slimming in the bottom of the cap-shaped closure means. The cross-sectional slimming must be pronounced enough in the axial direction to achieve the desired easy pivoting. On the other hand said slimming must be limited radially to avert undesired parallel motion in the axial direction.

In a development of the invention, the closure component comprises an axial stop located radially outside the cross-sectional slimming acting as a hinge to rest against an opposite mating stop at the bottle neck. Appropriately said stop is mounted in the radial region of the top end of a bottle neck forming the mating stop. Illustratively the stop may be formed merely by the conceptually extended bottom resting against the end surface of a bottle neck and thereby causing the closure means'bottom to be firmly positioned in the outer rim zone, thereby precluding axial motions of the hinge and hence axial motions of the sealing surface formed at the projection of the sealing element and hence also friction between the sealing surface and the cylindrical inner surface of the bottle neck. In this manner abrasion of and damage to this sealing surface caused by bulge changes of the closure-means bottom due to pressure variations cannot arise.

The axial stop at the closure component obviously must be designed to allow the overpressure to escape through this stop. If the stop is annular, this escape may be assured using radial channels or passages. However the stop may be in the form of discrete stop elements distributed along the periphery of the sealing element and thereby forming passages between them. Moreover the stop may be designed to rest against a projection outside the bottle neck, said projection then forming the mating stop.

In a further embodiment of the invention, a rib is present between the sealing cap and the cylindrical closure means, said rib bracing the elbow lever formed by the bottom and the closure component. As a result the motion of the bottom caused by bulging due to increasing pressure in a closed bottle is more effectively transmitted to the cylindrical sealing element and hence pressure relief, or lifting of the projection, is improved, especially regarding the inside pressure acting radially outward on the sealing element.

In the simplest cases, the advantageous rib effect can be achieved with only one rib. Obviously several peripherally equidistant ribs also may be used.

In a further appropriate development of this embodiment, in the region where it merges into the sealing element, the rib runs as far as a zone radially remote from the sealing projection. In this manner an unbraced and hence elastic region remains axially between the rib and the projection.

In a further development of this embodiment, in the region where it merges into the bottom, the rib runs as far as a zone which is radially remote from the axis or center of the closure component. This feature opposes degradation of bottom bulging with increasing pressure and hence the action as an overpressure valve is improved.

Lastly, the cross-sectional slimming is radially configured in such manner in a further development of the invention that the hinge it forms lies on the conceptually extended inside surface of the neck of a bottle. On account of this position of the slimming and hence of the hinge, the radially sealing projection resting against the inner wall of a bottle neck will only be pressure relieved or detached transversely to the inside surface of the bottle neck when the bottom of the closure cap bulges. In this manner axial frictional motions between the sealing projection along the inside surface of the bottle neck are opposed and thus also wear and leakage.

BRIEF DESCRIPTION OF THE DRAWING

The drawing is a cross-sectional and partial cutaway view of a closure component made in accordance with the present invention.

The invention is elucidated by an illustrative embodiment and in relation to a drawing.

DETAILED DESCRIPTION OF THE INVENTION

The drawing is a cross-section and partial cutaway view of a closure component 1 designed as a screw cap and screwed onto a bottle neck 2 only shown at its front part. The closure component 1 comprises a bottom 3 from which a cylindrical sealing part 4 runs axially inside the neck 2, said sealing part 4 comprising at its outside a projection 5 resting against a cylindrical inside surface 6 of the neck 2. The outside diameter of the projection 5 is slightly larger than the diameter of the inside surface 6 in such manner that the projection 5 when in its screw-on condition as shown, rests at a specified force against the inside surface 6. Accordingly the projection 5 is precluded from making contact with a front, inside edge 7 of the mouth of the neck 2.

Directly radially outside the sealing element 4, the bottom 3 comprises a cross-sectional slimming 8 forming a hinge; an elbow lever formed by the sealing element 4 and that part of the bottom 3 running radially inward from the cross-sectional slimming 8 is pivotable about said hinge.

An external and cylindrical retaining element 12 of the closure means 1 comprises an inner thread 13 at its inside to engage an outside thread 14 of the bottle neck 2. Also a stop 10 is present inside at the retaining element 12 and makes contact with a mating stop 11 formed at the top end of the bottle neck 2. In this manner the stop 10 and the mating stop 11 constrain an accurate and in particular a fixed position of the hinge formed by the cross-sectional slimming.

A rib 15 is mounted in the region of the angle between the bottom 3 and the sealing element 4 and is rigidly affixed to said bottom 3 and sealing element 4 and is integral with them. The rib 15 is triangular and runs radially as far as a zone which is away from the sealing projection 5 but ends in a radial zone away from the axis 16. Because of this slight radial inward dimension, the bracing of the bottom 3 is kept small with respect to bulging.

In use, and after filling the bottle with the neck 2 being discussed, the cap-shaped closure means 1 is screwed onto the neck 2 until the stop 10 comes to rest against the mating stop 11. In this process, the projection 5 at the sealing element 4 glides onto the inside surface 6 of the neck 2 and thusly seals the bottle-inside. If overpressure is generated in the bottle, for instance in case the beverage is gas-pressure generating, the bottom 3 will bulge outward so that its rims rotate about the cross-sectional slimming 8 representing a hinge. As a result, the arm formed by the sealing element 4 pivots radially inward and thereby the force with which the projection 5 presses against the inside surface 6 of the neck 2 is reduced. At a predetermined overpressure and hence at a predetermined bulging of the bottom 3, the projection 5 detaches off the inside surface 6, allowing the overpressure to escape. Thereby the bulge of the bottom 3 decreases and the projection 5 again comes to rest tightly against the inside surface 6. The rib 15 improves the transmission of the deviation of the bottom 3 caused by overpressure-bulging to the sealing element 4 and the elbow lever formed by the bottom 3 and the sealing element 4 is braced thereby. As a consequence the overall overpressure valve operates more sensitively and accurately to overpressure. In particular a specified blowoff pressure is more easily observed even at varying manufacturing tolerances.

Because the position of the hinge formed by the cross-sectional slimming 8 is made practically invariant by the stop 10 and the mating stop 11, axial displacements of the sealing element 4 are practically precluded and also relative motions between the projection 5 at the sealing element 4 and the inside surface 6 of the neck 2. Therefore the sealing effect remains unaffected even when frequent changes in pressure cause changes in the bulging of the bottom 3. Such changes merely entail changes in resting pressure by the projection 5 that however do not degrade sealing.

I claim:

1. A closure means for a bottle, comprising:

a) a cap-shaped closure component;

b) a projection directed inwardly from an edge of said cap-shaped closure component adapted to engage an outwardly directed projection at a neck of a bottle;

c) a substantially cylindrical sealing element extending axially from a bottom of said closure component, said sealing element being disposed within said closure component;

d) a radial projection extending from a radially outwardly facing surface of said sealing element and disposed away from said bottom and having a diameter larger than the inside diameter of the neck of the bottle to be sealed by said closure means in such a way that a sealing surface formed by said radial projection tightly rests against an inside surface of the neck in a closed mode;

e) said bottom comprises a cross-sectional slimming disposed radially beyond said cylindrical sealing element, said slimming has a thickness less than the thickness of an adjacent portion of said bottom such that said slimming functions as a hinge;

f) said bottom and said sealing element form an elbow lever pivotable about said hinge; and g) at least one rib disposed in a space formed between said bottom and said sealing element to brace said sealing element against movement relative to said bottom, such that upon bulging of said bottom said radial projection is substantially radially detached from the inside surface of the neck by a lever action of said elbow lever pivotable about said hinge.

2. Closure means as in claim 1, wherein said sealing element comprises an axial stop radially disposed beyond said cross-sectional slimming to rest against an opposite mating stop at the neck.

3. Closure means as in claim 2, wherein said axial stop is adapted positioned in a radial region of a top end of the neck forming said mating stop.

4. Closure means as in claim 1, wherein said at least one rib runs axially along said sealing element as far as into a zone away from said radial projection in a region merging into said sealing element.

5. Closure means as in claim 4, wherein in said region said rib terminates radially away from an axis of said closure component.

6. Closure means as in claim 1, wherein said rib is triangular.

7. Closure means as in claim 1, wherein said cross-sectional slimming is disposed radically inwardly of a radially outermost surface of the radial projection.

* * * * *